US006921008B2

(12) United States Patent
Matthiesen et al.

(10) Patent No.: US 6,921,008 B2
(45) Date of Patent: Jul. 26, 2005

(54) SETTING TOOL

(75) Inventors: Sven Matthiesen, Lindau (DE); Johann Buechel, Sevelen (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/935,655

(22) Filed: Sep. 7, 2004

(65) Prior Publication Data

US 2005/0051592 A1 Mar. 10, 2005

(30) Foreign Application Priority Data

Sep. 9, 2003 (DE) ..... 103 41 821

(51) Int. Cl.[7] ..... B25C 1/14
(52) U.S. Cl. ..... 227/10
(58) Field of Search ..... 227/8, 9, 10, 130; 123/46 SC

(56) References Cited

U.S. PATENT DOCUMENTS 3,622,060 A * 11/1971 Gussalli ..... 227/8
3,804,314 A * 4/1974 Gilbert ..... 227/10
3,860,161 A * 1/1975 Engstrom et al. ..... 227/10
4,134,527 A * 1/1979 Termet ..... 227/10
4,821,938 A * 4/1989 Haytayan ..... 227/10
5,170,922 A * 12/1992 Ehmig et al. ..... 227/8
6,015,078 A * 1/2000 Almeras et al. ..... 227/10
6,039,229 A * 3/2000 Pfister et al. ..... 227/10
6,126,055 A * 10/2000 Gantner et al. ..... 227/10
6,857,548 B1 * 2/2005 Clark ..... 227/130

* cited by examiner

*Primary Examiner*—Scott A. Smith
(74) *Attorney, Agent, or Firm*—Sidley Austin Brown & Wood, LLP

(57) ABSTRACT

A setting tool for driving in fastening elements includes a piston guide (13) located in the receptacle (12) and having a hollow chamber (14) in which a setting piston (15) is displaceably arranged, a safety element (21), a piston return element (16), an operational member (17) for operating the piston return element (16), a transmission member (22) for transmitting movement of the operational member (17) to the piston return element (16), and a manually actuatable actuation element (30) having a first adjustment section (31) connected with the safety element (21) and a second adjustment section (32) connected with the transmission member (22) for simultaneous displacement of the safety element (21) and the transmission member (22) in their respective release positions (24, 28) or their safety position (23) and the transmission position (27), respectively.

7 Claims, 3 Drawing Sheets

SETTING TOOL

BACKGROUND OF THE INVENTION

1. Field of the Invention

The present invention relates to a setting tool for driving in fastening elements and including a housing having a receptacle, a piston guide located in the receptacle and having a hollow chamber in which a setting piston is displaceably arranged, a safety element having a safety position in which it prevents the piston guide from displacing out of the receptacle, and a release position in which the piston guide can be displaced out of the receptacle, a piston return element having a servo component extending into the piston guide, an operational member for operating the piston return element, and a transmission member for transmitting movement of the operational member to the piston return element and having a transmitting position in which it is connected with the piston return element, and a release position in which it is disconnected from the piston return element.

2. Description of the Prior Art.

Setting tools of the type described above can be driven with solid, gaseous, or liquid fuels or with compressed air. In combustion-driven setting tools, the setting piston is driven with combustion gases. The setting piston drives a fastening element in an object.

The bolt driving-in setting tools should be capable of being easily disassembled and assembled by the user for cleaning purposes. With semi-automatic, hand-held setting tools, the piston guide, the setting piston, and the piston return element should form together a unit removable from the setting tool.

In the combustion-engined setting tool HILTI-DX 750 of the assignee herein, the setting piston is displaced in a piston guide which is located in a receptacle of one- or multi-part tool housing. It is possible to disassemble this tool for maintenance purposes. For securing the piston guide in the setting tool, there is provided a safety element between the piston guide and the piston guide receptacle and which is displaced by a manually operable adjustment member from a safety position in a release position in which the safety element is lifted off the piston guide. For disassembly, in order to be able to remove the piston guide and the setting piston out of the setting tool, it is also necessary to release the piston return element that engages in the piston guide and serves for return of the piston from its setting position to its initial position. To this end, there is provided on the setting tool another manually actuatable operational or adjustment member with which a transmission member is displaced from an engaging position, in which it engages the piston return element, to a disengaging position.

A drawback of the above described setting tool is that for disassembly of the piston guide with the bolt guide and the setting piston, two adjustment members should be actuated by the tool user, which increases the disassembly time. It should be taken into account that a setting tool is subjected to cleaning often.

Accordingly, an object of the invention is a setting tool of the type described above in which the drawback of a conventional tool (described above) is eliminated, and an easy mounting/dismounting (assembly/disassembly) of the piston guide, together with the setting piston, is possible.

SUMMARY OF THE INVENTION

This and other objects of the present invention, which will become apparent hereinafter, are achieved by providing a manually actuatable actuation element having a first adjustment section connected with the safety element and a second adjustment section connected with the transmission member for simultaneous displacement of the safety element and the transmission member in one of their respective release positions and their safety position and the transmission position, respectively.

With provision of an actuation element having a first adjustment section connected with the safety element, and a second adjustment section connected with the transmission member, permits to simultaneously displace the safety element and the transmission member into their release position when the actuation element is displaced by the tool user in its respective position from its initial position. The safety element and the transmission member can be displaced to their respective safety position and transmission position when the actuation element is displaced by the user into its initial position. The actuation element with two adjustment sections noticeably simplifies and makes more convenient dismounting of the piston guide, together with the setting piston.

Advantageously, the actuation element is formed as a lever with an eccentric shaft secured thereto. With the lever, which is preferably provided with a handle at one of its ends, the user can easily manually actuate it for transmitting rotational movement to the eccentric shaft connected with the lever. Advantageously, there is provided an intermediate member that connects the actuation element with the transmission member. The intermediate member permits to span a rather large distance between the actuation element and the transmission member in the tool housing. The intermediate member can be formed as an elastic annular member circumscribing the piston guide. The intermediate member has a support section that surrounds the second eccentric of the eccentric shaft on the second adjustment section. The intermediate member is displaced about the piston guide which permits to dispense with constructional adaptation of the piston guide. Thereby, the present invention can be used with a setting tool having a conventional piston guide. This reduces the costs of the modification of a conventional setting tool. The support section of the elastic annular intermediate member reliably transmits the movement of the eccentric of the eccentric shaft to the transmission member upon actuation of the actuation element.

According to a particulary advantageous embodiment of the present invention, the operational member has in a region of the transmission member a crank and the intermediate member has an actuation section that, in a disassembling position of the operational member, is engageable in the crank for displacing the transmission member in its release position. The actuation section is blocked from engagement in the crank in all positions of the operational member except the disassembling position. The foregoing measure permits to effect assembly and disassembly of the setting tool in a precisely predetermined position of the operational member, namely, in its disassembling position. The disassembling position of the operational member is retained as long as the lever of the actuation element remains in its actuated, i.e., pivot-out position, because in this position of the lever, the actuation section of the intermediate member is engaged in the crank. When the operational member is in its disassembling position, and with an elastic intermediate member, the lever and, thereby the actuation element, can be actuated by the user. This movement is stored in the elastic intermediate member until the operational member is displaced by the user, together with the crank, in a correct position in which the actuation section of the intermediate member can engage in the crank. As soon as the actuation section engages in the crank, the transmission member is lifted off the piston return element and is displaced in its release position.

Advantageously, the operational member is formed as a handle displaceable over the housing, e.g., as a repeat grip. This insures an easy actuation of the piston return element.

Advantageously, the safety element has a support section that surrounds a first eccentric of the eccentric shaft associated with the first adjustment section. This insures a reliable actuation of the safety element with the actuation means in both operational direction and return direction.

The novel features of the present invention, which are considered characteristic for the invention, are set forth in the appended claims. The invention itself, however, both as to its construction and its mode of operation, together with additional advantages and objects thereof, will be best understood from the following detailed description of preferred embodiment when read with reference to the accompanying drawings.

DETAILED DESCRIPTION OF THE PREFERRED EMBODIMENT

Figure 1:
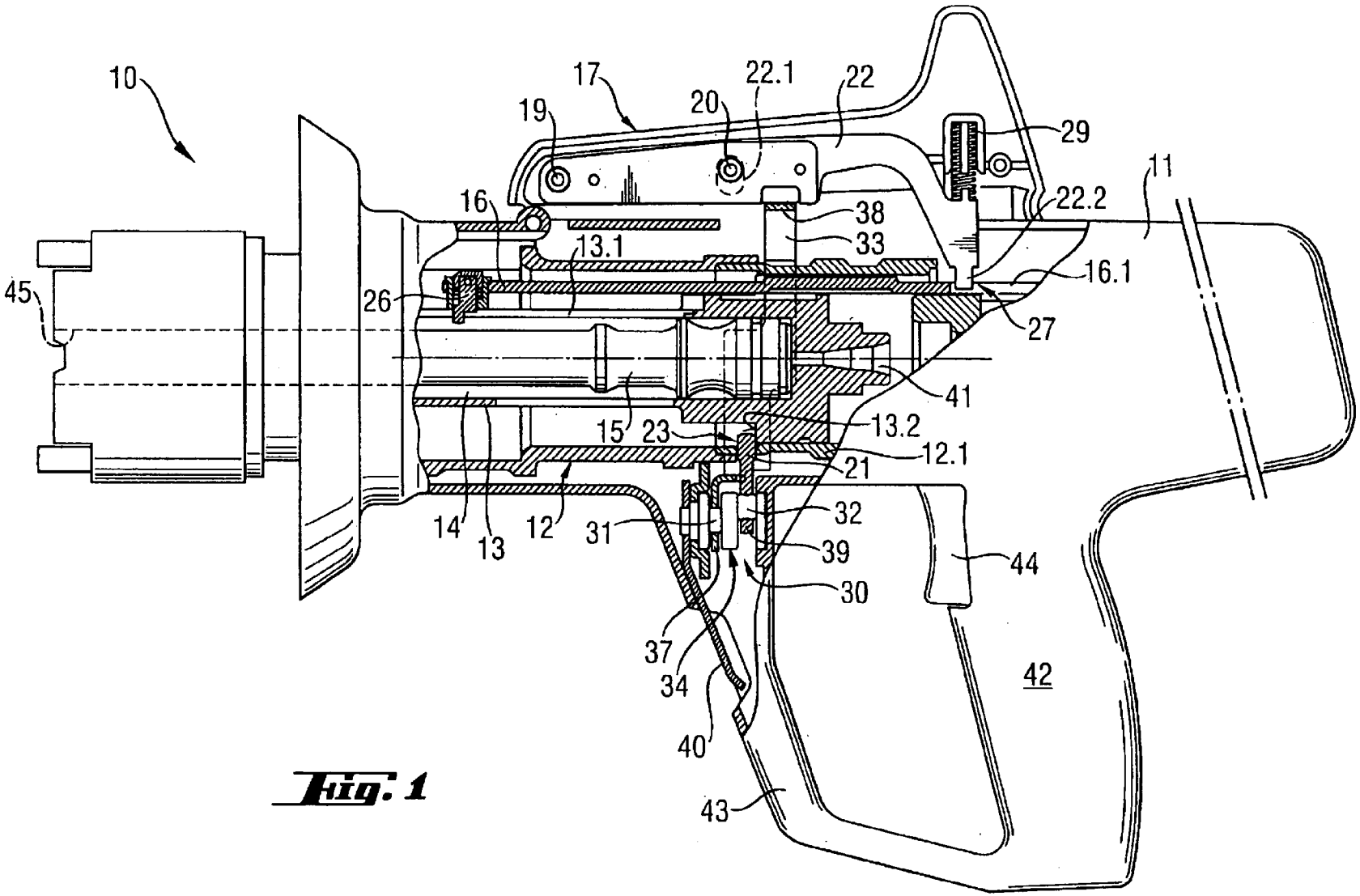
FIG. 1: a side, partially cross-sectional view of a setting tool according to the present invention.

A setting tool 10 according to the present invention, which is shown in the drawings, includes a one- or multi-part housing 11, a piston guide 13 arranged in the housing 11 and having a hollow chamber 14 in which a setting piston 15 is displaceably arranged. The setting piston 15 is driven by appropriate propellant means or by products of its reaction. In the embodiment of the setting tool 10 shown in the drawings, at the end of the piston guide 13, there is provided a cartridge socket 41 for receiving a propellant charge. The piston guide 13 is arranged in a receptacle 12 of a sleeve-shaped part 12.1 located in the housing 11. The piston guide 13 is displaceably supported in the receptacle 12 against a biasing force of a spring (not shown in the drawings). A setting process of the setting tool 10 is only possible when the setting tool 10 is pressed with its outlet portion 45 against a constructional component or another object. The setting tool 10 is actuated with an actuating switch 44 provided on a handle 42 of the setting tool 10.

Figure 3:
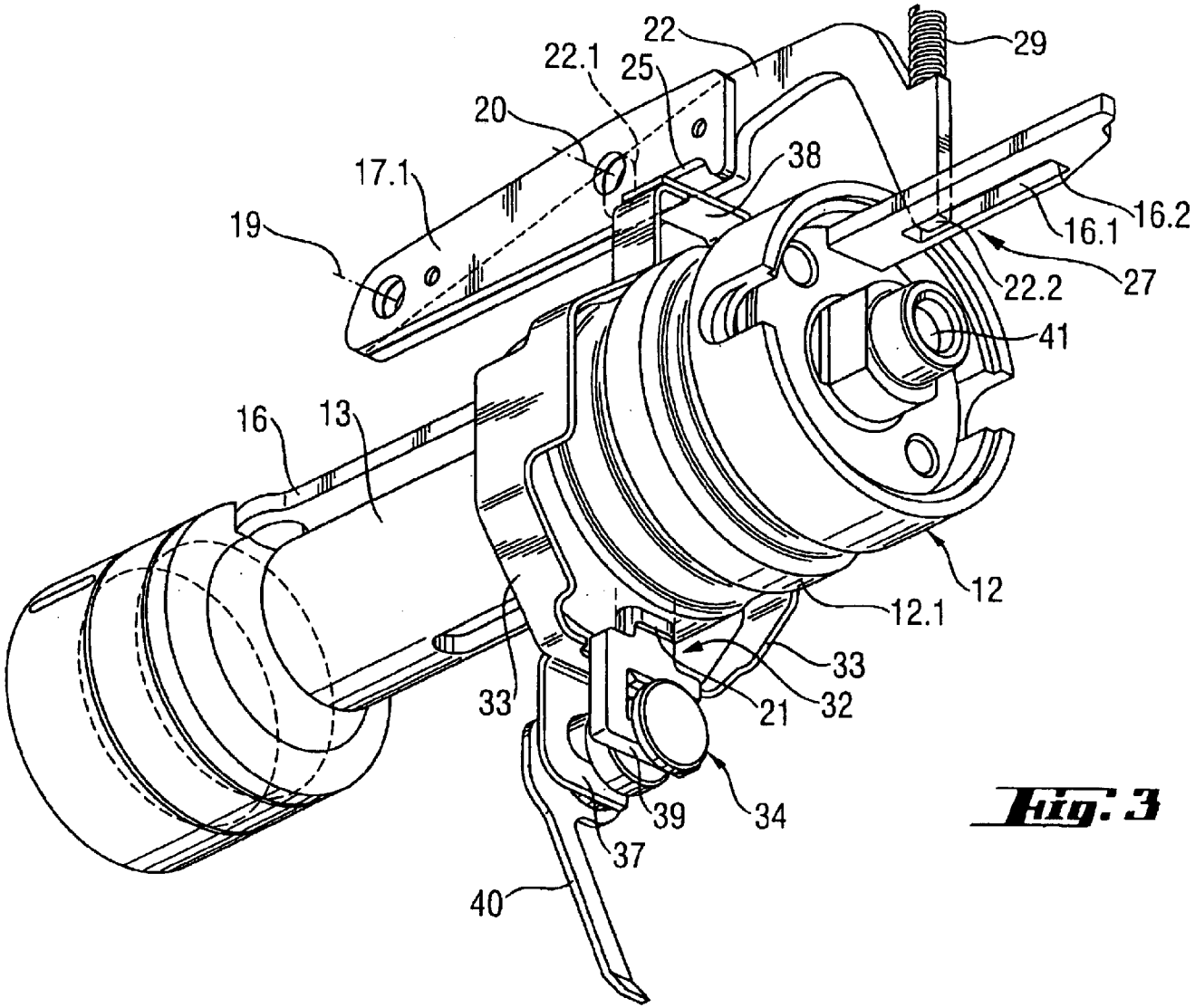
FIG. 3: a perspective view of the section of the setting tool shown in FIG. 2 with the safety element for the piston guide in a safety position and with the piston return element.

Between the piston guide 13 and the sleeve-shaped part 12.1, there is arranged a piston return element 16 provided, at its end adjacent to the outlet portion 45 of the setting tool 10, with a servo component 26. The servo component 26 extends through a window 13.1 and projects into the hollow chamber 14 of the piston guide 13. The servo component 26 of the piston return element 16 is provided for return of the setting piston 15, after completion of a setting process, from its position adjacent to the outlet part 45 to its initial position in front of the cartridge socket 41. The piston return element 16 can be displaced by a tool user via an operational member 17 formed as a handle or as a repeat grip and displaceable over the housing 11. To this end, there is provided on the piston return element 16, in its region remote from the outlet part 45, an opening 16.1 into which a projection 22.2 of a transmission member 22 extends. The transmission member 22 is connected with the operational member 17 at its support 19. In FIGS. 1 and 3, the transmission member 22 is shown in its transmitting position in which the projection 22.2 extends into the opening 16.1 of the piston return element 16. The transmission member 22 is held in its transmitting position with a spring 29 that supports the transmission member 22 against the operational member 17. The transmission member 22 pivots about its support 19. The pivot angle of the transmission member 22 is limited by a spigot 20 which is secured to the operational member 17 and extends through an elongated hole 22.1 formed in the transmission member 22.

In order to remove the piston guide 13, together with the setting piston 15, from the setting tool 10, the projection 22.2 of the transmission member 22 should be lifted off the opening 16.1 of the piston return element 16. Otherwise, upon removal of the unit piston guide 13-setting piston 15, the projection 22.2 would rest on a stop 16.2 of the piston return element 16 (see FIGS. 2–3). For pivoting the transmission member 22, there is provided an intermediate member 33 having an actuation section 38 located in a region between the elongated hole 22.1 and the projection 22.2. In the embodiment shown in the drawings, the intermediate member 33 is formed as a ring-shaped part consisting, in principle, of two stirrups. At its end remote from the actuation section 38, the intermediate member 33 has a support section 37 that encompasses a first eccentric 35 of an eccentric shaft 34 of a manually actuatable actuation element 30. The actuation element 30 has two adjustment sections 31 and 32 that cooperate, respectively, with first and second eccentrics 35 and 36 of the eccentric shaft 34. The actuation element 30 is operated with a handle 40 arranged thereon. The actuation element 30 is arranged on a front stirrup 43 of the handle 42 of the setting tool 10 (see FIG. 1). With the actuation element 30, not only the transmission member 22, together with the projection 22.2, can be lifted off the opening 16.1 of the piston return element 16, but also a safety element 21 that extends through an opening in the sleeve-shaped part 12.1 and cooperates with a stop 13.2 of the piston guide 13 to limit the displacement of the piston guide 13, defining a safety position 23 of the piston guide 13. In the safety position 23, the piston guide 13 cannot be displaced out of the receptacle 12 (see FIGS. 1 and 3). On the safety element 21, there is provided a support section 39 that encompasses the first eccentric 35 of the eccentric shaft 34 of the actuation element 30. On the actuation member 17, there is provided a crank carrier 17.1 that carries or supports a crank 25 (see FIGS. 2–3).

Figure 2:
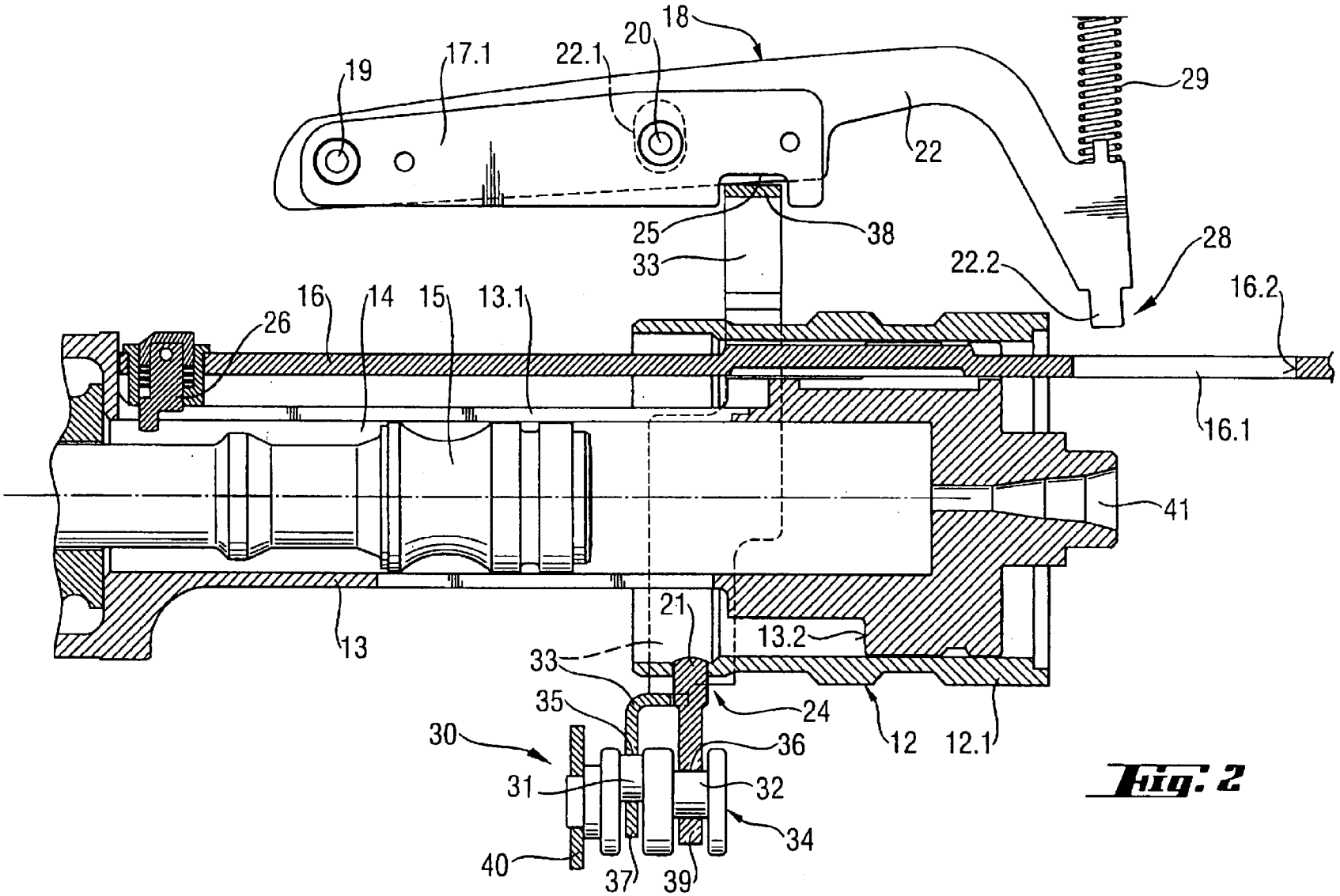
FIG. 2: a cross-sectional view of a section of the setting tool shown in FIG. 1 with a safety element for the piston guide in a release position and with the piston return element.

In case the setting tool 10 should be disassembled and the unit piston guide 13-setting piston 15-piston return element 16 should be removed from the housing 11, the user should first shift the handle 40 of the actuation element 30 from its pivot-in position shown in FIG. 1 into its actuation position shown in FIG. 2. At that, the actuation member 17 or the repeat grip should be located in a disassembling position 18 shown in FIG. 2. Only in this position, the actuation section 38 of the intermediate member 33 can be inserted into the crank 25 of the crank carrier 17.1 to thereby lift the transmission member 22, together with its projection 22.2, off the opening 16.1 of the piston return member 16. The intermediate member 33 can be formed as an elastic member, so that the displacement of the handle 40 of the actuation element 30 and, thereby, the movement of the eccentric shaft 34, together with the eccentrics 35, 36, is also possible with the actuation member 17 not being located in the disassembling position 18. In such a case, the intermediate member 32 would move upwardly, with its movement being buffered by its elasticity. The transmission member 22 would not yet be able to be displaced from its release position shown in FIG. 2 because the actuation section 38 had not yet engaged in the crank 25. However, the safety element 21 would be able to move from its safety position 23 shown in FIGS. 1 and 3 into its release position 24 shown in FIG. 2 due to cooperation of the eccentric 36 with the support section 39. By displacement of the actuation member 17 over the housing 11 until the actuation section 38 engages in the crank 25, the transmission member 22 can be lifted, together with the projection 22.2, off the opening 16.1 against the biasing force of the spring 29 and, thus, be shifted to its release position 28 shown in FIG. 2. Advantageously, the actuation member 17 is held in its disassembling position 18 due to cooperation of the actuation section 38 of the intermediate member 33 as long as the handle 40 is located in its pivot-out position. This insures a following assembly of the setting tool 10 in a simple manner.

As a rule, the actuation member 17 is displaced in its disassembling position 18 before the actuation element 30 is pivoted, with its handle 40, out so that upon the actuation element 30 being pivoted out, the actuation section 38 can be directly introduced into the crank 25.

According to one embodiment of the invention, the transmission member is formed as a pure safety element, without any return function. Such a transmission member, which is formed as a second safety element, can directly be engageable with the piston guide.

Further, the actuation element 30 can be arranged in another location of the setting tool than that shown in the drawings, e.g. it can be arranged above the tool handle on the housing 11 of the setting tool 10.

Though the present invention was shown and described with references to the preferred embodiment, such is merely illustrative of the present invention and is not to be construed as a limitation thereof, and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A setting tool for driving in fastening elements, comprising a housing (11) and having a receptacle (12); a piston guide (13) located in the receptacle (12) and having a hollow chamber (14); a setting piston (15) displaceably arranged in the hollow chamber (14) of the piston guide (13); a safety element (21) having a safety position (23) in which it prevents the piston guide (13) from displacing out of the receptacle (12), and a release position (24) in which the piston guide (13) can be displaced out of the receptacle (12); a piston return element (16) having a servo component (26) extending into the piston guide (13); an operational member (17) for operating the piston return element (16); a transmission member (22) for transmitting movement of the operational member (17) to the piston return element (16) and having a transmitting position (27) in which it is connected with the piston return element (16), and a release position in which it is disconnected from the piston return element (16); and a manually actuatable, actuating element (30) having a first adjustment section (31) connected with the safety element (21) and a second adjustment section (32) connected with the transmission member (22) for simultaneous displacement of the safety element (21) and the transmission member (22) in one of their respective release positions (24, 28) and their safety and transmission positions (23, 27), respectively.

2. A setting tool according to claim 1, wherein the actuation element (30) is formed as a lever with an eccentric shaft (34) arranged thereon.

3. A setting tool according to claim 2, further comprising an intermediate member (33) for operationally connecting the actuation element (30) with the transmission member (22) and surrounding the piston guide (13), the intermediate member (33) having a support section (37) that surrounds a first eccentric (35) of the eccentric shaft (34) associated with the first adjustment member (31).

4. A setting tool according to claim 3, wherein the intermediate member (33) is formed as an elastically resilient member.

5. A setting tool according to claim 3, wherein the operational member (17) has, in a region of the transmission member (22), a crank (25), and wherein the intermediate member (33) has an actuation section (38) that, in a disassembling position (18) of the operational member (17), is engageable in the crank (25) for displacing the transmission member (22) in the release position (28) thereof, the actuation section (38) being blocked from engagement in the crank (25) in all positions of the operational member (17) except the disassembling position.

6. A setting tool according to claim 3, wherein the safety element (21) has a support section (39) that surrounds a second eccentric (36) of the eccentric shaft (34) associated with the second adjustment section (32).

7. A setting tool according to claim 1, wherein the operational member (17) is formed as a handle displaceable over the housing (11).

* * * * *